US008875555B2

(12) United States Patent
Iwata et al.

(10) Patent No.: US 8,875,555 B2
(45) Date of Patent: Nov. 4, 2014

(54) BOSSED DISC-LIKE MEMBER MANUFACTURING METHOD AND BOSSED DISC-LIKE MEMBER MANUFACTURING APPARATUS

(75) Inventors: Daisuke Iwata, Nishio (JP); Masanori Sato, Nagoya (JP); Masayuki Maki, Nisshin (JP); Yohei Mukaida, Okazaki (JP)

(73) Assignee: Aisin Aw Co., Ltd., Anjo (JP)

( * ) Notice: Subject to any disclaimer, the term of this patent is extended or adjusted under 35 U.S.C. 154(b) by 592 days.

(21) Appl. No.: 13/210,876

(22) Filed: Aug. 16, 2011

(65) Prior Publication Data

US 2012/0073350 A1 Mar. 29, 2012

(30) Foreign Application Priority Data

Sep. 29, 2010 (JP) ..... 2010-218324

(51) Int. Cl.

| | |
|---|---|
| ***B21D 22/00*** | (2006.01) |
| ***B21D 31/00*** | (2006.01) |
| ***B21C 23/18*** | (2006.01) |
| ***B21D 22/21*** | (2006.01) |
| ***B21D 22/24*** | (2006.01) |
| ***B21K 23/00*** | (2006.01) |

(52) U.S. Cl.

CPC ..... *B21D 22/21* (2013.01); *B21C 23/186* (2013.01); *B21D 22/24* (2013.01); *B21K 23/00* (2013.01)

USPC ..... 72/347; 72/327

(58) Field of Classification Search

CPC ..... B21D 22/02; B21D 22/24; B21D 22/28; B21D 24/005; B21D 24/02

USPC ..... 72/347–349, 353.2, 353.4, 354.6, 72/355.2, 355.4, 357, 327

See application file for complete search history.

(56) References Cited

FOREIGN PATENT DOCUMENTS

| | | |
|---|---|---|
| JP | A-01-180728 | 7/1989 |
| JP | A-07-241624 | 9/1995 |
| JP | A-2001-347331 | 12/2001 |
| JP | A-2004-344968 | 12/2004 |
| JP | A-2005-007467 | 1/2005 |

OTHER PUBLICATIONS

Nov. 22, 2011 (mail date) Search Report issued in International Application No. PCT/JP2011/070960 (w/Translation).

*Primary Examiner* — Debra Sullivan
(74) *Attorney, Agent, or Firm* — Oliff PLC

(57) ABSTRACT

A bossed disc-like member manufacturing method and apparatus with which it is possible to simply form a boss portion with a desired height. The method includes a level difference formation step that moves a second portion, which is positioned on the inner peripheral side of a first portion in a radial direction of a disc-like blank, relative to the first portion in a first direction which is the thickness direction of the blank, thus forming a level difference between the first portion and the second portion. A conical portion formation step moves the second portion relative to the first portion in a second direction opposite to the first direction, eliminating the level difference. In this manner, a conical portion is formed in the second direction on the inner side of the second portion; and a burring step performs a burring process on the conical portion, thus forming the boss portion.

12 Claims, 15 Drawing Sheets

BOSSED DISC-LIKE MEMBER MANUFACTURING METHOD AND BOSSED DISC-LIKE MEMBER MANUFACTURING APPARATUS

INCORPORATION BY REFERENCE

The disclosure of Japanese Patent Application No. 2010-218324 filed on Sep. 29, 2010, including the specification, drawings and abstract thereof, is incorporated by reference in its entirety.

BACKGROUND OF THE INVENTION

1. Field of the Invention

The present invention relates to a manufacturing method of a bossed disc-like member having a boss portion formed on one surface of the disc-like member in such a way as to project upright in the thickness direction, and to a manufacturing apparatus of the bossed disc-like member.

2. Description of the Related Art

When manufacturing a kind of disc-like member 62, in a central portion of which a boss portion 60 is formed, shown in FIG. 13, in order to form the boss portion 60 with a desired height H, it is necessary to secure capacity in the central portion of the disc-like member 62. Herein, the boss portion 60 is a portion projecting upright from a surface of the disc-like member 62 in the thickness direction of the disc-like member 62. Therefore, in order to secure the capacity in the central portion of the disc-like member 62, in a heretofore known technology, while a plurality of drawing steps are carried out, a punching step and a burring step are each carried out. However, as the plurality of drawing steps are carried out, the number of steps increases, and manufacturing cost increases. Also, as the plurality of drawing steps are carried out, a large number of drawing scores occur in the disc-like member 62, and the flatness of the disc-like member 62 decreases. Herein, the drawing scores are scores made by dies used in the drawing steps making contact.

Herein, JP-B-3-53049 discloses a technology of forming a boss portion by carrying out the drawing step and the burring step while gathering a material configuring a blank by forcibly pressing an outer periphery of the blank.

SUMMARY OF THE INVENTION

However, with the technology of JP-B-3-53049, as it is necessary to pressurize the outer side of the blank from a plurality of directions, a manufacturing apparatus becomes special and larger in scale. Also, as a high pressure is applied to the outer periphery of the blank from dies, a galling by the dies, or the like, occurs, and a lifespan of the dies is shortened. For this reason, manufacturing cost increases. Herein, the galling by the dies is a defect of die surfaces caused by, for example, a seizing (adhesion) of the blank onto the dies.

Therefore, the invention, having been made in order to solve the heretofore described problems, has a problem of providing a bossed disc-like member manufacturing method and a bossed disc-like member manufacturing apparatus with which it is possible to form a boss portion with a desired height with simple equipment.

One aspect of the invention made in order to solve the heretofore described problem is a manufacturing method of a bossed disc-like member, being formed a boss portion which projects upright in the thickness direction of a disc-like member on a surface of the disc-like member, including a level difference formation step which moves a second portion, which is positioned on the inner peripheral side of a first portion in a radial direction of a disc-like blank, relative to the first portion in a first direction which is the thickness direction of the blank, thus forming a level difference between the first portion and the second portion; a conical portion formation step which moves the second portion relative to the first portion in a second direction opposite to the first direction, eliminating the level difference, thus forming a conical portion projecting in the second direction in a region on the inner peripheral side of the second portion; and a burring step which performs a burring process on the conical portion, thus forming the boss portion.

According to the aspect, the boss portion is formed by processing the blank by deforming it in the thickness direction of the blank. For this reason, as there is no need to forcibly press the outer periphery of the blank as in the heretofore known technology, it is possible to make equipment simple. Also, it is possible to suppress an occurrence of a galling by dies. Consequently, it is possible to lengthen a lifespan of the dies. Consequently, it is possible to reduce manufacturing cost.

Also, a material configuring the blank gathers toward a central portion, and a capacity of the blank in the central portion increases. Because of this, it is possible to form the boss portion with a desired height.

In the heretofore described aspect, it is preferable that a pair of dies disposed across the second portion are moved in the first direction in the level difference formation step, and moved in the second direction in the conical portion formation step.

According to the aspect, it is possible to form the boss portion with a one-stroke movement of the pair of dies. Because of this, it is possible to make the equipment simple, meaning that it is possible to reduce manufacturing cost. Herein, the one-stroke movement of the pair of dies is a movement wherein the pair of dies are reciprocated once in the first direction and the second direction.

In the heretofore described aspect, it is preferable that the pair of dies are comprised a first die and a second die, and that the first die presses the second portion in the level difference formation step, and holds the second portion in the burring step.

According to the aspect, as the first die is used as a punch which presses the blank, as well as being used as a die which holds the blank, it is possible to reduce the number of dies. For this reason, it is possible to make the equipment simple, meaning that it is possible to reduce manufacturing cost.

In the heretofore described aspect, it is preferable that in the level difference formation step, the conical portion formation step, and the burring step, a state is maintained in which the second portion is clamped by the pair of dies, while being pressurized.

According to the aspect, it is possible to prevent a position misalignment of the blank when processing the blank. For this reason, the accuracy of the coaxiality of an outer peripheral portion of the disc-like member with the boss portion improves.

In the heretofore described aspect, it is preferable that in the level difference formation step, the conical portion formation step, and the burring step, a state is maintained in which a region of the blank on the outer peripheral side of the first portion is clamped by a pair of holding members from the first direction and the second direction.

According to the aspect, it is possible to suppress a flow of the material configuring the blank to the outer peripheral side.

Because of this, it is possible to form the boss portion with the desired height. Also, the flatness of a planar portion of the disc-like member improves.

In the heretofore described aspect, it is preferable that the blank is provided with a hole in the central portion.

According to the aspect, it is possible to carry out a positioning of the blank and the dies by inserting one portion of the dies into the hole. Because of this, the accuracy of the coaxiality of the outer peripheral portion of the disc-like member with the boss portion further improves. Also, as it is possible to omit the step of making the hole in the central portion of the blank, it is possible to make the equipment simple.

Another aspect of the invention made in order to solve the heretofore described problem is a manufacturing apparatus of a bossed disc-like member, being formed a boss portion which projects upright in the thickness direction of a disc-like member on a surface of the disc-like member, including a first die and a second die disposed across a second portion which is positioned on the inner peripheral side of a first portion in a radial direction of a disc-like blank, wherein the first die moves in a first direction which is the thickness direction of the blank, and presses the second portion, thereby moving the second portion in the first direction relative to the first portion, thus forming a level difference between the first portion and the second portion, the first die moves in a second direction opposite to the first direction, moving the second portion in the second direction relative to the first portion, eliminating the level difference, thus forming a conical portion projecting in the second direction in a region on the inner peripheral side of the second portion, and a burring process is performed on the conical portion in a condition in which the first die holds the second portion, thus forming the boss portion.

According to a bossed disc-like member manufacturing method and a bossed disc-like member manufacturing apparatus according to the invention, it is possible to form a boss portion with a desired height with simple equipment.

DETAILED DESCRIPTION OF THE EMBODIMENTS

A detailed description will be given, while referring to the accompanying drawings, of an embodiment in which the invention is embodied. FIGS. 1 to 5 are sectional views showing a bossed disc-like member manufacturing apparatus, FIGS. 6 to 9 are sectional views of a blank, and FIGS. 10 to 13 are external perspective views of the blank.

[Description of Bossed Disc-like Member Manufacturing Apparatus]

Figure 1:
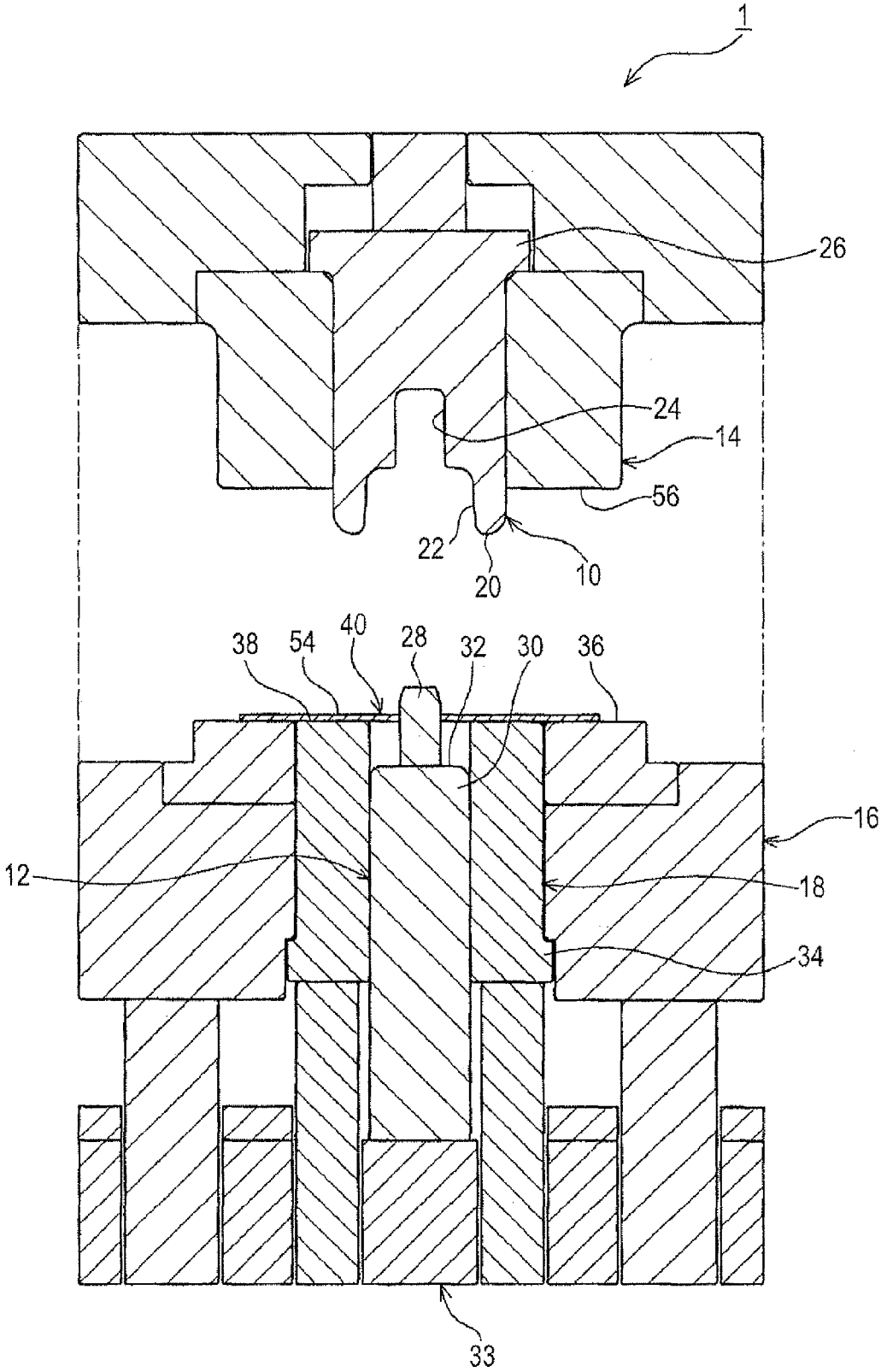
FIG. 1 is a sectional view showing a bossed disc-like member manufacturing apparatus in an initial step.

FIG. 1 is a diagram showing a bossed disc-like member manufacturing apparatus 1 in a condition in which each die is positioned in an initial position in an initial step to be described hereafter. The manufacturing apparatus 1 of this working example is an apparatus which manufactures a disc-like member 62 on which a boss portion 60 is formed, as shown in the previously mentioned FIG. 13. The disc-like member 62 is an example of a "bossed disc-like member" of the invention.

As shown in FIG. 1, the manufacturing apparatus 1 of the working example includes dies such as a burring die 10, a burring punch 12, a first holding member 14, a second holding member 16, and a lifter 18.

The burring die 10 is such that the lower side in FIG. 1 (a side on which the burring punch 12 is disposed) is formed in a cylindrical form, and a leading end portion 20 is provided at a leading end thereof. Then, a first space portion 22 and a second space portion 24 are formed, in order from the lower side in FIG. 1, inside an inner peripheral surface of the burring die 10 in such a way that the burring punch 12 can be inserted therein. The inside diameter of the first space portion 22 is formed to be larger than the inside diameter of the second space portion 24. Also, the leading end portion 20 of the burring die 10 is formed in an R form (a rounded form).

Also, the burring die 10 is such that a radially expanded portion 26 expanded in the radial direction is formed in an end portion thereof in the upward direction in FIG. 1 (a direction opposite to a direction in which the burring punch 12 is disposed). The outside diameter of the radially expanded portion 26 is formed to be larger than the inside diameter of a portion of the first holding member 14 in which the burring die 10 is inserted. By so doing, the movement of the burring die 10 in the downward direction in FIG. 1 (the direction in which the burring punch 12 is disposed) is restricted.

The burring punch 12 is a mechanism which functions as a punch in a burring step to be described hereafter. The burring punch 12 is such that a first column portion 28 and a second column portion 30, each of which is formed in a columnar form, are formed in order from the upper side in FIG. 1 (a side on which the burring die 10 is disposed). Then, the outside diameter of the second column portion 30 is formed to be larger than the outside diameter of the first column portion 28. By so doing, a planar portion 32 flattened in the left-right direction in FIG. 1 (a radial direction of the burring punch 12) is formed on a surface of the second column portion 30 outside an outer peripheral surface of the first column portion 28 in a boundary portion between the first column portion 28 and the second column portion 30.

The outside diameter of the first column portion 28 of the burring punch 12 is formed to be smaller than the inside diameter of the second space portion 24 of the burring die 10.

Also, the outside diameter of the second column portion 30 of the burring punch 12 is formed to be larger than the inside diameter of the second space portion 24 of the burring die 10, while it is formed to be smaller than the inside diameter of the first space portion 22 of the burring die 10. By so doing, in the burring step, to be described hereafter, the burring punch 12 can be inserted into the burring die 10 in such a way that the first column portion 28 of the burring punch 12 is inserted into the second space portion 24 of the burring die 10, and the second column portion 30 of the burring punch 12 is inserted into the first space portion 22 of the burring die 10. Also, the burring punch 12, being connected to a base plate 33, moves integrally with the base plate 33.

The first holding member 14 is a mechanism for clamping and holding a blank 40 with the second holding member 16 to be described hereafter. The first holding member 14, being formed in a cylindrical form, is such that the previously described burring die 10 is inserted inside an inner peripheral surface thereof in a condition in which it is movable in the up-down direction in FIG. 1 (a direction of a central axis of the first holding member 14).

The second holding member 16 is a mechanism for clamping and holding the blank 40 with the previously described first holding member 14. The second holding member 16, being formed in a cylindrical form, is such that the lifter 18 is inserted inside an inner peripheral surface thereof in a condition in which it is movable in the up-down direction in FIG. 1 (a direction of a central axis of the second holding member 16). The first holding member 14 and the second holding member 16 are an example of a "pair of holding members" of the invention.

The lifter 18 is a mechanism for clamping and holding the blank 40 with the previously described burring die 10. The lifter 18, being formed in a cylindrical form, is such that the first column portion 28 and the second column portion 30 of the burring punch 12 are inserted inside an inner peripheral surface thereof in a condition in which they are movable in the up-down direction in FIG. 1 (a direction of a central axis of the lifter 18).

Also, the lifter 18 is such that a radially expanded portion 34 expanded in the radial direction is formed in an end portion thereof in the downward direction in FIG. 1 (a direction opposite to the direction in which the burring die 10 is disposed). The outside diameter of the radially expanded portion 34 is formed to be larger than the inside diameter of the second holding member 16 on the upper side in FIG. 1 (the side on which the burring die 10 is disposed). By so doing, the movement of the lifter 18 in the upward direction in FIG. 1 (the direction in which the burring die 10 is disposed) is restricted.

[Description of Bossed Disc-like Member Manufacturing Method]

Next, a description will be given of a bossed disc-like member manufacturing method using the manufacturing apparatus 1 with this kind of configuration.

<Initial Step>

Firstly, as an initial step, the burring die 10 and the first holding member 14 remain positioned in an initial position, as shown in FIG. 1. At this time, a space is formed between the burring die 10 and the lifter 18, and between the first holding member 14 and the second holding member 16. Also, the planar portion 32 of the burring punch 12 is maintained so as to be positioned below an upper surface 36 of the second holding member 16 and an upper surface 38 of the lifter 18, as seen in FIG. 1. Then, the blank 40 is disposed on the upper surface 36 of the second holding member 16 and the upper surface 38 of the lifter 18.

Figure 10:
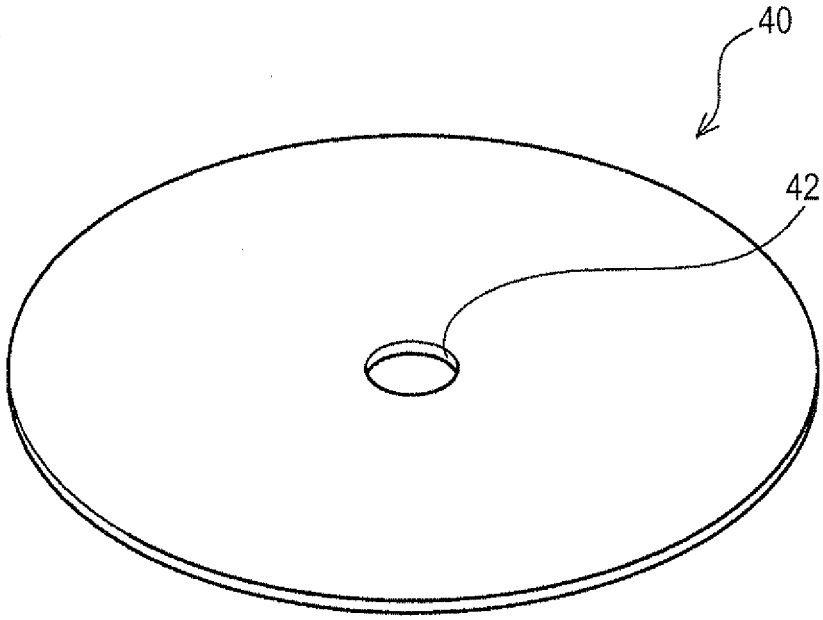
FIG. 10 is an external perspective view of the blank before being processed.
Figure 11:
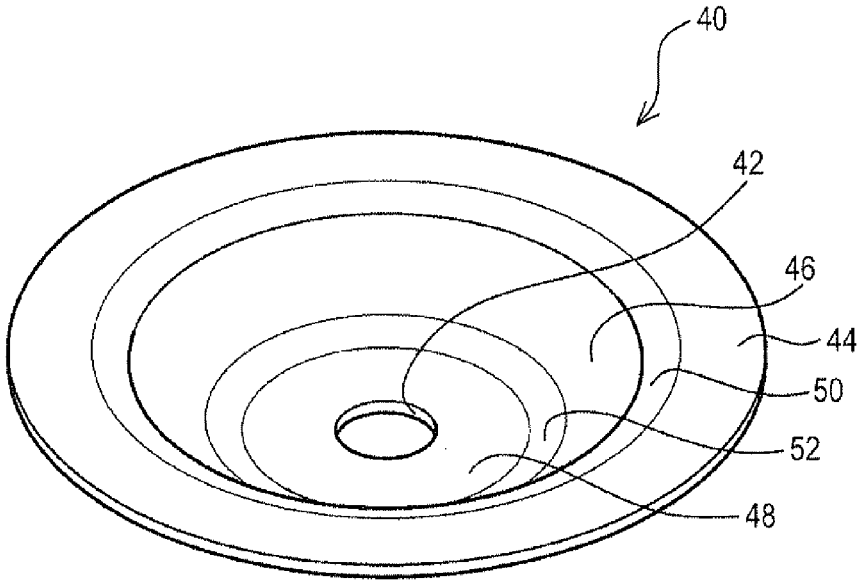
FIG. 11 is an external perspective view of the blank after the drawing step.
Figure 12:
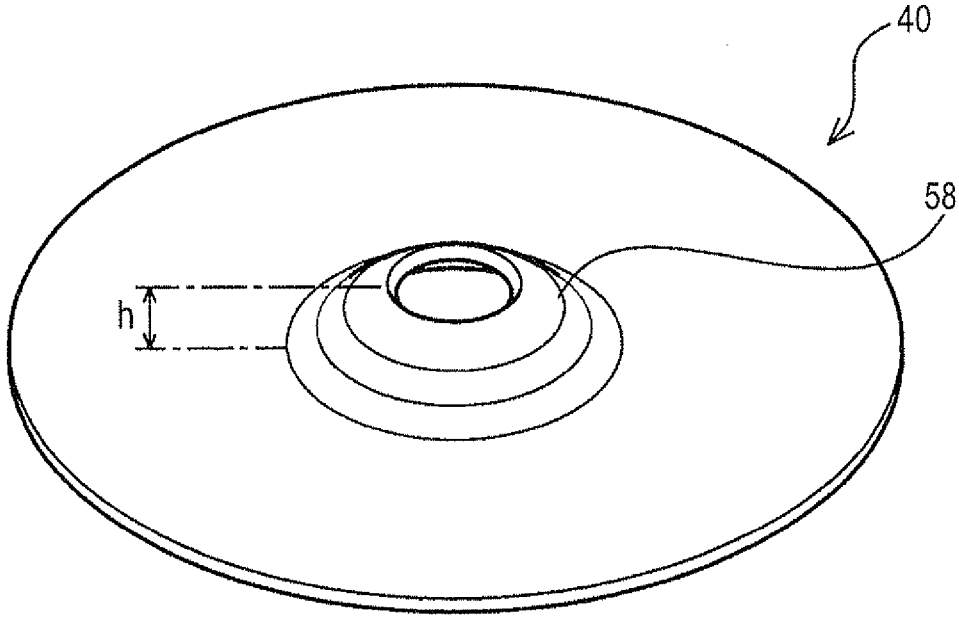
FIG. 12 is an external perspective view of the blank after the conical portion formation step.

FIG. 10 is an external perspective view of the blank 40 (a work) before being processed. As shown in FIG. 10, the blank 40 is a blank made of a metal, such as iron, formed in a disc form, and a hole 42 is provided in a central portion in advance. Then, as shown in FIG. 1, the first column portion 28 of the burring punch 12 is inserted into the hole 42. By so doing, it is possible to regulate a positional relationship between the burring punch 12 and the blank 40 in the radial direction of the blank 40, meaning that positioning of the blank 40 and each die is possible.

Figure 6:
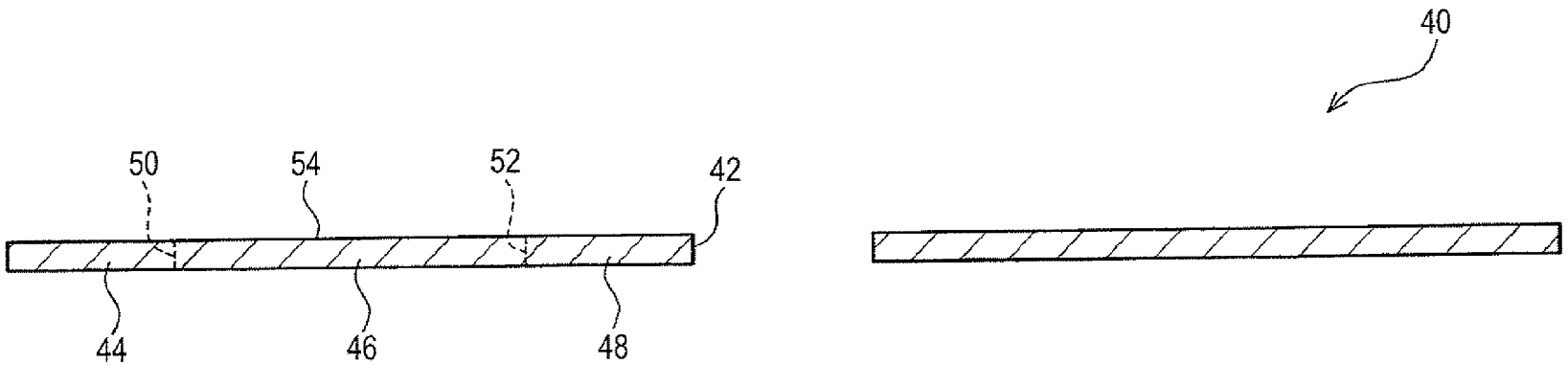
FIG. 6 is a sectional view showing a blank before being processed.

In the following description, for ease of description, it is supposed that the blank 40 configures a first region 44, a second region 46, and a third region 48, in order from an outer peripheral portion toward an inner peripheral portion, in a radial section of the blank 40, as shown in FIG. 6. Also, a boundary portion between the first region 44 and the second region 46 is taken to be a first portion 50, and a boundary portion between the second region 46 and the third region 48 is taken to be a second portion 52. That is, the second portion 52 is positioned closer to the inner peripheral side of the blank 40 than the first portion 50. FIG. 6 is a radial sectional view of the blank 40.

<Blank Contact Step>

Figure 2:
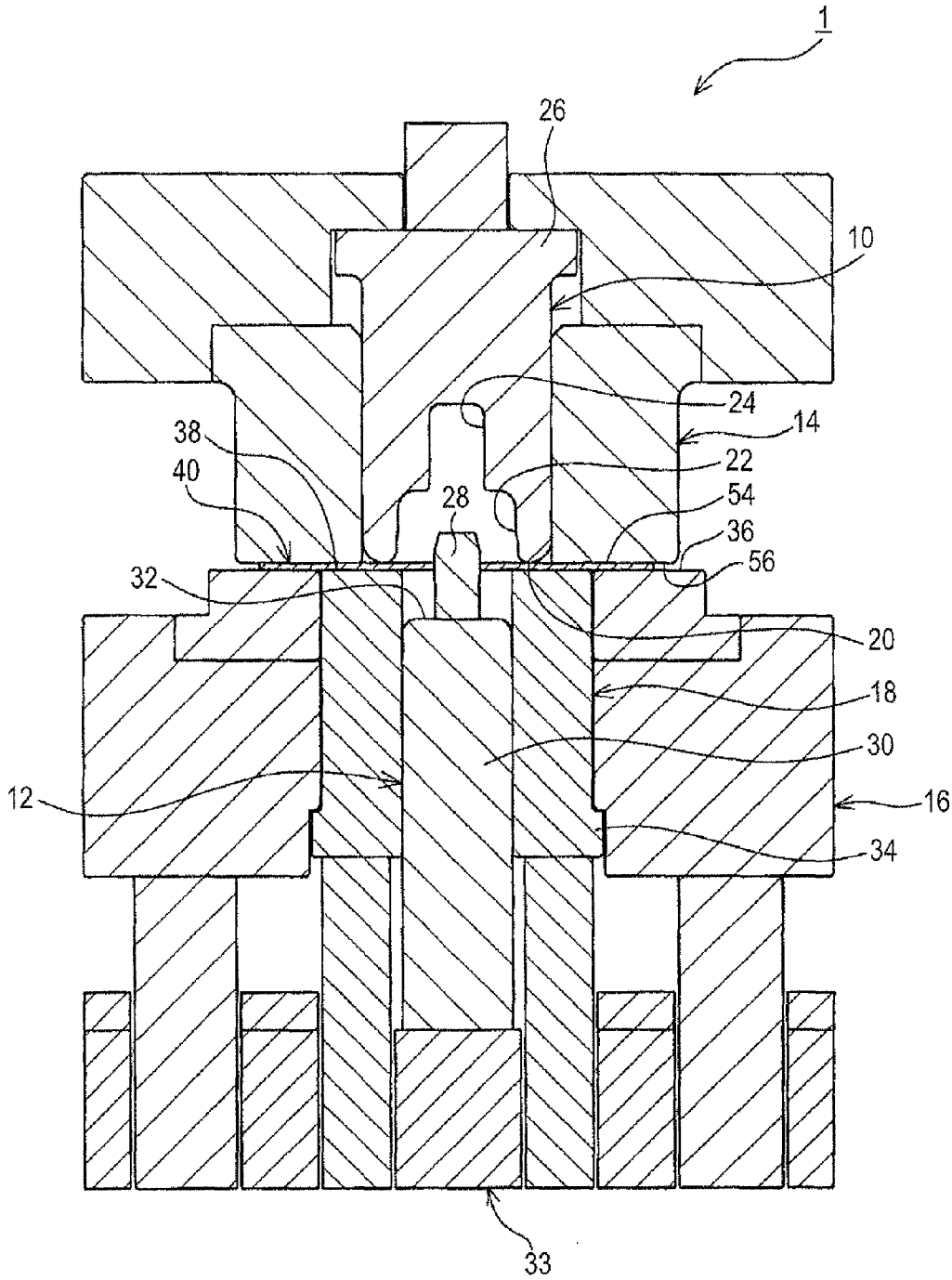
FIG. 2 is a sectional view showing the bossed disc-like member manufacturing apparatus in a blank contact step.

Next, the burring die 10 and the first holding member 14 are integrally moved in the downward direction in FIG. 2 (a direction in which the blank 40 is disposed) and, as shown in FIG. 2, the leading end portion 20 of the burring die 10 and a leading end surface 56 of the first holding member 14 are brought into contact with an upper surface 54 of the blank 40.

More specifically, while pressure is applied to the second portion 52 of the blank 40 from the leading end portion 20 of the burring die 10, the second portion 52 of the blank 40 is clamped by the leading end portion 20 of the burring die 10 and the upper surface 38 of the lifter 18. The method of applying pressure to the blank 40 from the leading end portion 20 of the burring die 10 not particularly being limited, for example, a method of applying hydraulic pressure with a hydraulic cylinder is conceivable.

Also, in a condition in which pressure is applied to the blank 40 from the leading end surface 56 of the first holding member 14, the first region 44 (refer to FIG. 6) of the blank 40 is clamped between the leading end surface 56 of the first holding member 14 and the upper surface 36 of the second holding member 16, and one portion of the second region 46 (refer to FIG. 6) of the blank 40 is clamped between the leading end surface 56 of the first holding member 14 and the upper surface 38 of the lifter 18. The first portion 50 (refer to FIG. 6) of the blank 40 is positioned in a boundary portion between the second holding member 16 and the lifter 18 in the radial direction of the blank 40. Also, the method of applying pressure to the blank 40 from the leading end surface 56 of the first holding member 14 not particularly being limited, for example, a method of applying hydraulic pressure with a hydraulic cylinder is conceivable.

<Drawing Step>

Figure 3:
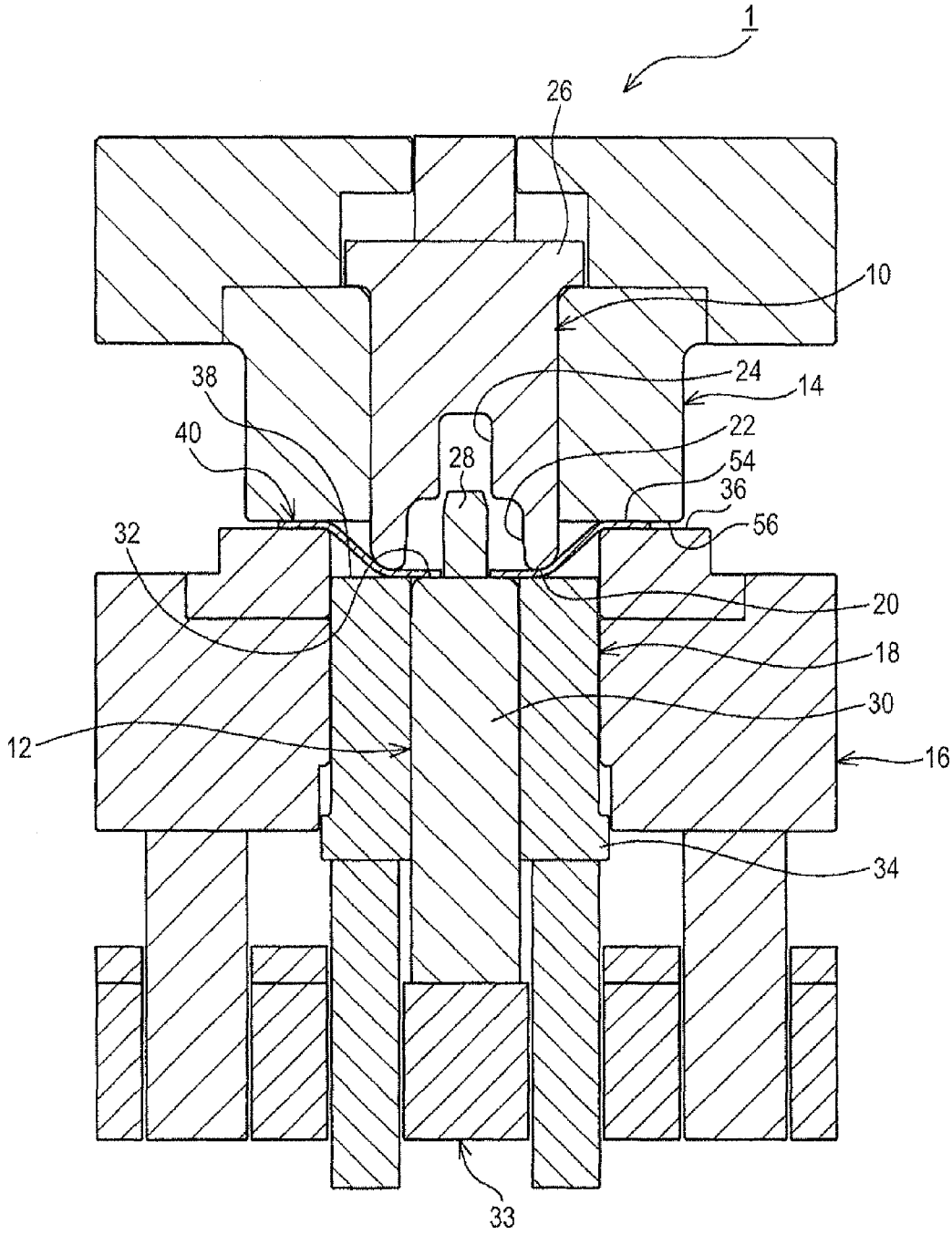
FIG. 3 is a sectional view showing the bossed disc-like member manufacturing apparatus in a drawing step.

Next, as a drawing step, the burring die 10 and the lifter 18 are integrally moved in the downward direction in FIG. 3 in a condition in which the second portion 52 of the blank 40 is clamped by the leading end portion 20 of the burring die 10 and the upper surface 38 of the lifter 18, as shown in FIG. 3, while pressure is applied to the second portion 52 of the blank 40 from the leading end portion 20 of the burring die 10. In this way, the leading end portion 20 of the burring die 10 presses the second portion 52 of the blank 40. The drawing step is an example of a "level difference formation step" of the invention. Also, the burring die 10 and the lifter 18 are an example of a "pair of dies" of the invention, the burring die 10 is an example of a "first die" of the invention, and the lifter 18 is an example of a "second die" of the invention.

In this way, the drawing process is carried out in such a way that a projecting portion 64 (refer to FIG. 7) with a diameter sufficiently larger than that of the boss portion 60 is formed in a direction (the downward direction in FIG. 3) opposite to a direction in which the boss 60 (refer to FIG. 13), to be described hereafter, is formed. By so doing, the blank 40 attains a kind of external appearance in FIG. 11. The movement of the burring die 10 and the lifter 18 is restricted by the radially expanded portion 26 of the burring die 10 making contact with the first holding member 14. Because of this, it is possible to regulate the depth of the projecting portion 64.

Also, in the drawing step, a condition is maintained in which the first region 44 of the blank 40 is clamped by the leading end surface 56 of the first holding member 14 and the upper surface 36 of the second holding member 16. By so doing, it is possible to maintain the flatness of the first region 44 of the blank 40.

Figure 7:
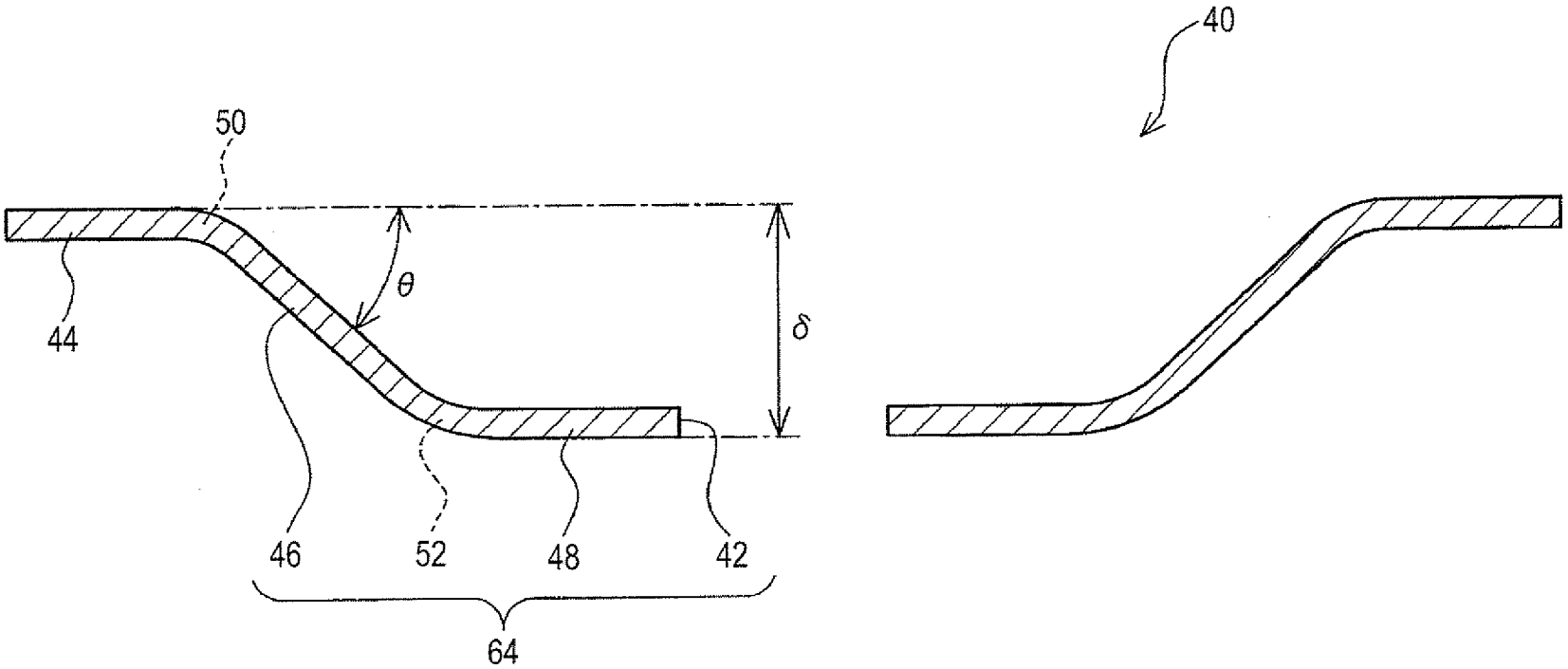
FIG. 7 is a sectional view showing the blank after the drawing step.

By carrying out this kind of drawing step, as shown in FIG. 7, the second portion 52 moves downward in the thickness direction (the direction of the central axis) of the blank 40 relative to the first portion 50, and a direction in which the second region 46 is formed is inclined in directions in which the first region 44 and the third region 48 are formed, forming a level difference δ between the first portion 50 and the second portion 52 in the thickness direction of the blank 40.

Also, it is desirable that an angle θ (refer to FIG. 7) formed by the direction in which the first region 44 of the blank 40 is formed and the direction in which the second region 46 is formed is 35° or more to 50° or less. When the angle θ is larger than 50°, there is a possibility that a material configuring the blank 40 flows to the outer peripheral portion side, the outside diameter expands, and a preliminary boss 58 is not raised (not formed) in a conical portion formation step to be described hereafter. Meanwhile, when the angle θ is smaller than 35°, there is a possibility that a height h of the preliminary boss 58 becomes too small, after which it is not possible to form the boss portion 60 with a desired height H in the burring step to be described hereafter.

Also, as the material configuring the blank 40 gathers toward the central portion, the outside diameter of the blank 40 decreases, and the capacity of the blank 40 in the central portion increases. Because of this, it is possible to form the boss portion 60 with the desired height H using the burring step to be described hereafter.

Also, the third region 48 in a perimeter portion of the hole 42 may be either brought into contact with or not brought into contact with the planar portion 32 of the burring punch 12. Also, the third region 48 does not have to be formed parallel to the left-right direction in FIG. 5 (the radial direction of the blank 40), and may be formed so as to be inclined from the second portion 52 toward the burring die 10 (in the upward direction in FIG. 3). At this time, for example, it is conceivable to move the planar portion 32 of the burring punch 12 farther in the upward direction in FIG. 3 than the upper surface 38 of the lifter 18, and incline the third region 48.

In this way, the manufacturing method of the working example requires only one drawing step, meaning that it is possible to suppress an occurrence of drawing scores in the blank 40. Also, it is possible to reduce manufacturing cost.

<Conical Portion Formation Step>

Figure 4:
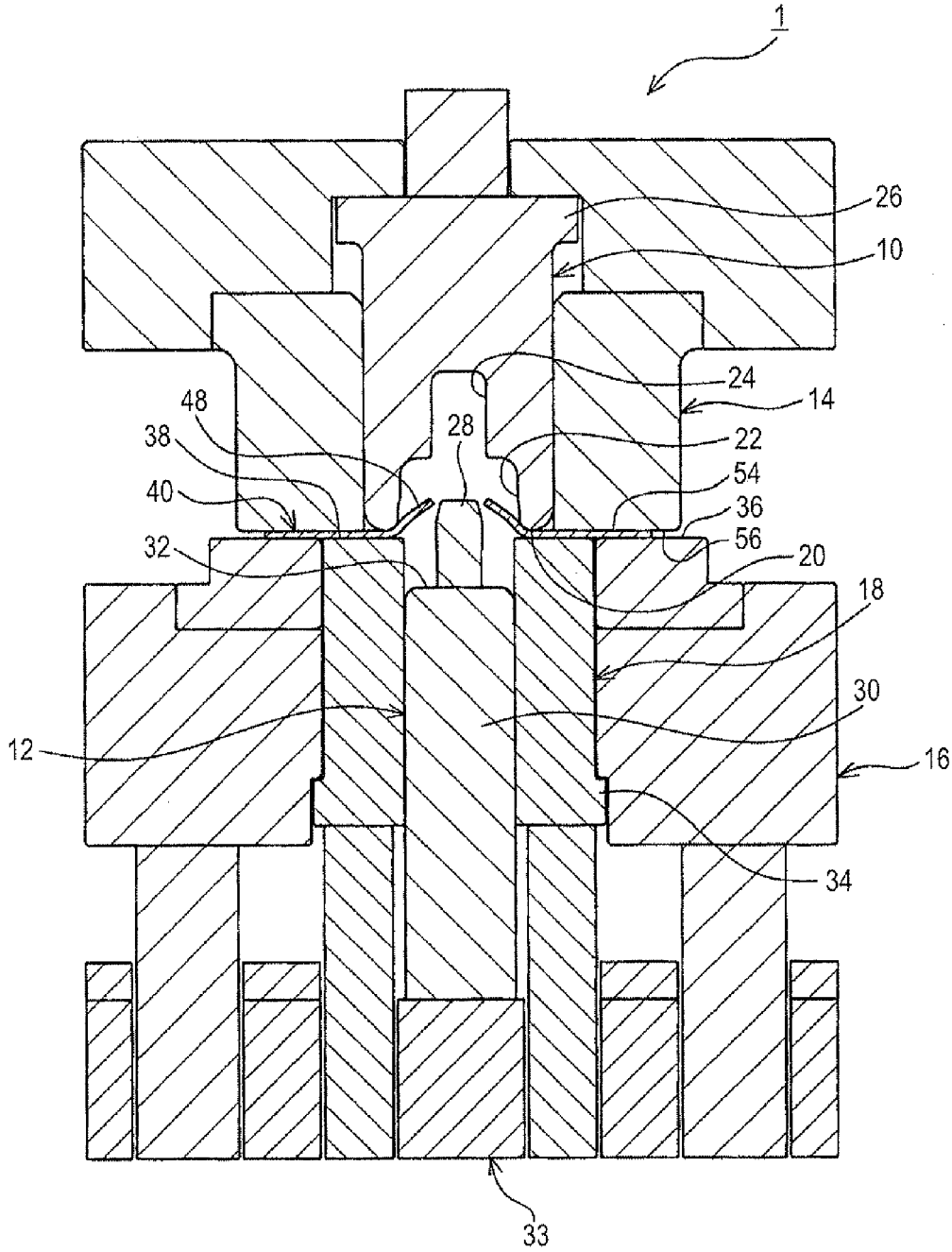
FIG. 4 is a sectional view showing the bossed disc-like member manufacturing apparatus in a conical portion formation step.

Next, as the conical portion formation step, as shown in FIG. 4, the burring die 10 and the lifter 18 are integrally moved in the upward direction in FIG. 4 (a direction opposite to the direction in which the blank 40 is disposed, as seen from the burring die 10). By so doing, a one-stroke movement of the burring die 10 and the lifter 18 is carried out. At this time, the third region 48 of the blank 40 remains placed in a free condition so as not to be clamped. The movement of the burring die 10 and the lifter 18 is restricted by the radially expanded portion 34 of the lifter 18 making contact with the second holding member 16. Because of this, it is possible to regulate in such a way that up-down direction positions of the upper surface 36 of the second holding member 16 and the upper surface 38 of the lifter 18 are the same.

Figure 8:
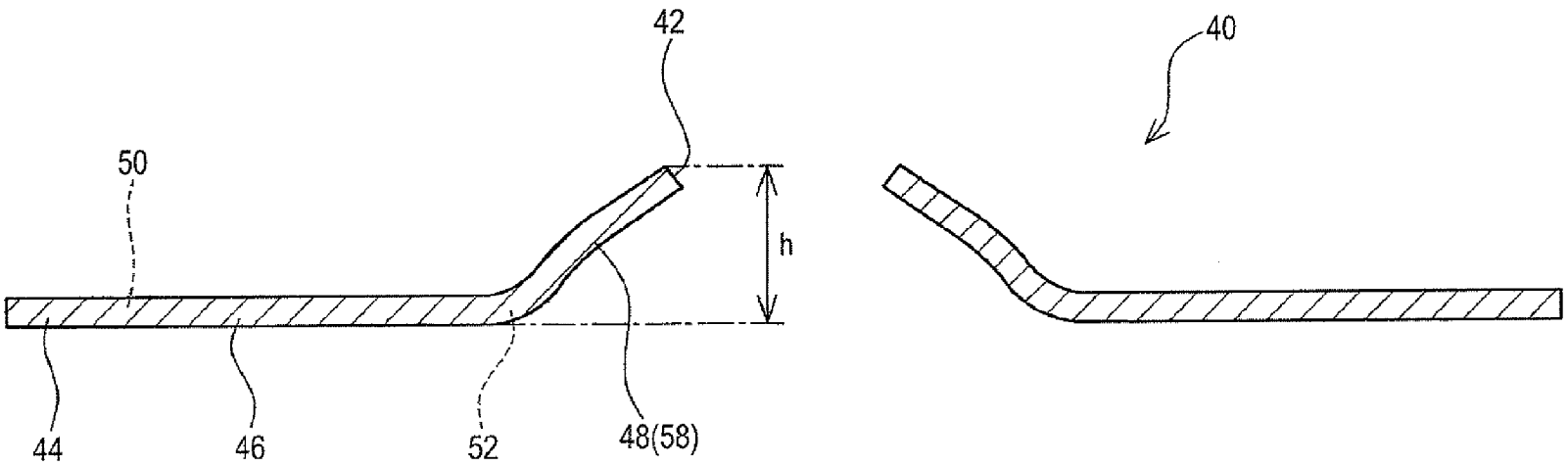
FIG. 8 is a sectional view showing the blank after the conical portion formation step.

By carrying out this kind of conical portion formation step, as shown in FIG. 8, the second portion 52 moves relative to the first portion 50 in the upward direction in FIG. 8 (the thickness direction of the blank 40), meaning that the level difference δ formed in the heretofore described drawing step is eliminated. That is, the first region 44 and the second region 46 are formed linearly in the radial direction of the blank 40, and the level difference δ portion is returned to a planar condition. At this time, the third region 48 which is a region of the blank 40 on the inner peripheral side of the second portion 52, even though not subjected to any kind of processing, rises in a direction in which the boss portion 60 is intended to be formed owing to the rigidity of the blank 40 (in the upward direction in FIG. 8), and the conical preliminary boss 58 with the height h is formed as shown in FIG. 17. The preliminary boss 58 is an example of a "conical portion" of the invention. Also, as the material configuring the blank 40 gathers in the central portion, the capacity of the central portion increases, and the diameter of a preliminary boss 58 portion decreases. For this reason, no reduction in the thickness of the blank 40 occurs in the preliminary boss 58 portion.

The burring die 10 and the lifter 18 are integrally moved in a condition in which the second portion 52 of the blank 40 is clamped by the leading end portion 20 of the burring die 10 and the upper surface 38 of the lifter 18 while pressure is applied to the second portion 52 of the blank 40 from the leading end portion 20 of the burring die 10. By so doing, it is possible to prevent a position misalignment of the blank 40.

Also, in the conical portion formation step, the first region 44 of the blank 40 remains clamped by the leading end surface 56 of the first holding member 14 and the upper surface 36 of the second holding member 16. By so doing, it is possible to suppress a flow of the material configuring the blank 40 to the outer peripheral side from the central portion, and it is possible to maintain the thickness of the central portion of the blank 40. Also, it is possible to maintain the flatness of the first region 44 of the blank 40.

<Burring Step>

Figure 5:
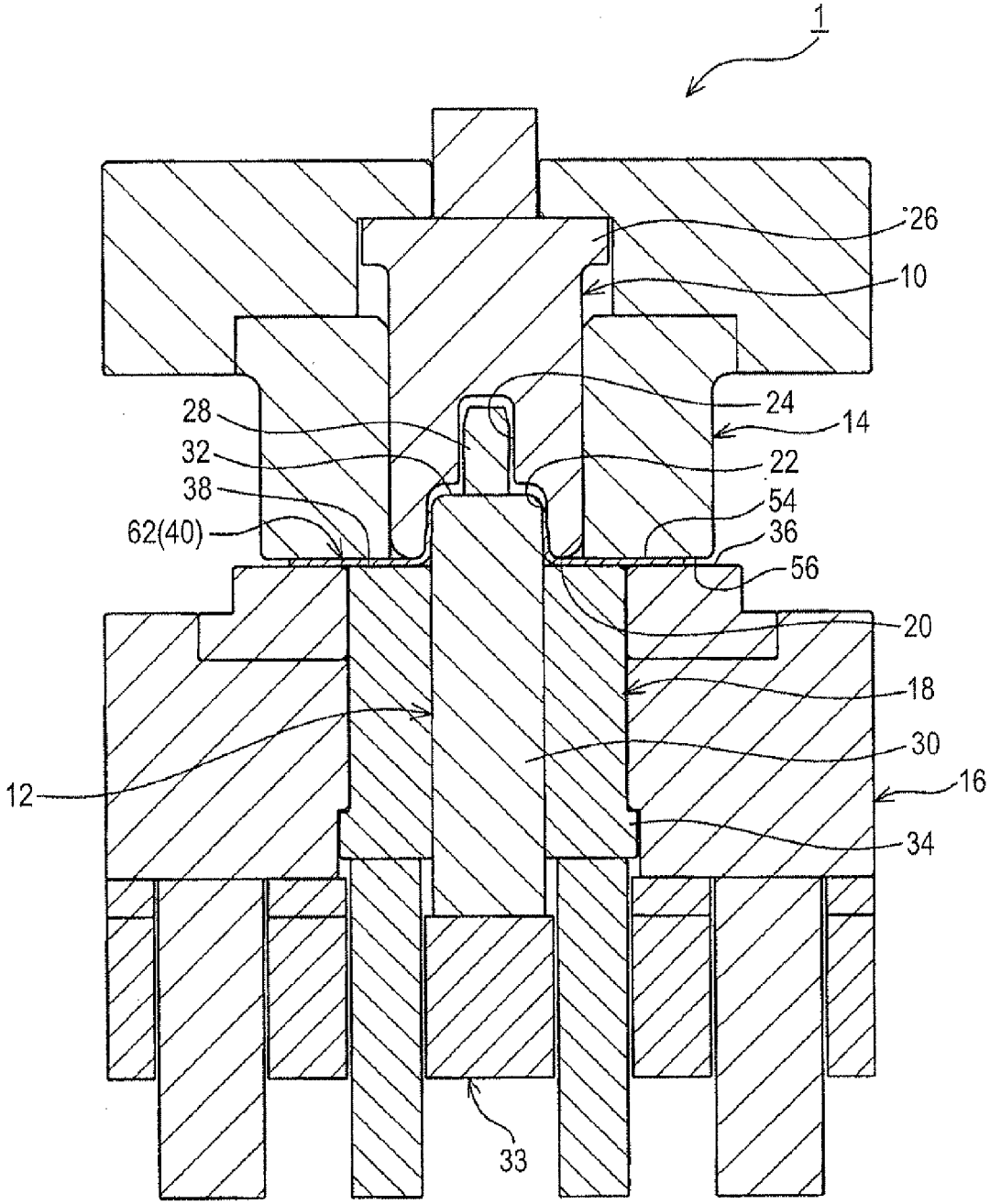
FIG. 5 is a sectional view showing the bossed disc-like member manufacturing apparatus in a burring step.
Figure 9:
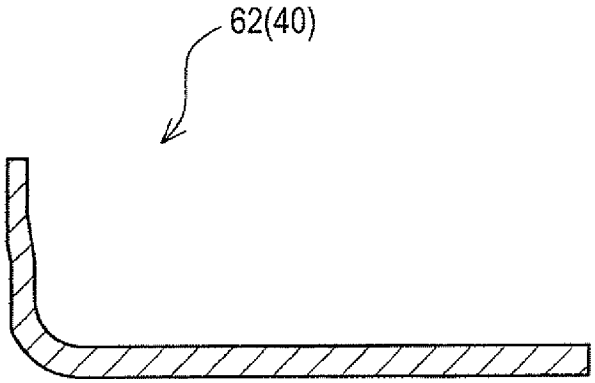
FIG. 9 is a sectional view showing the blank after the burring step.
Figure 9:
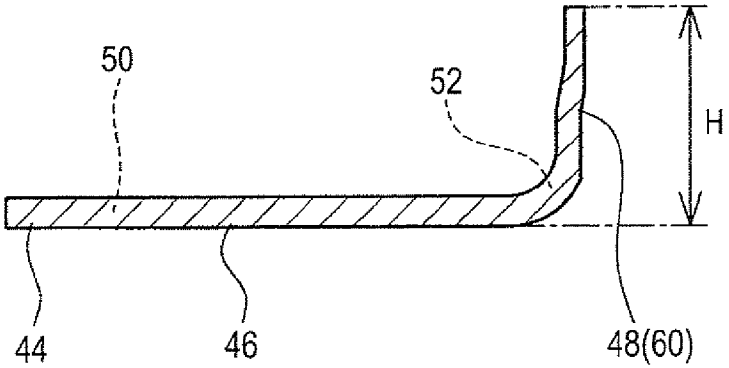
Figure 13:
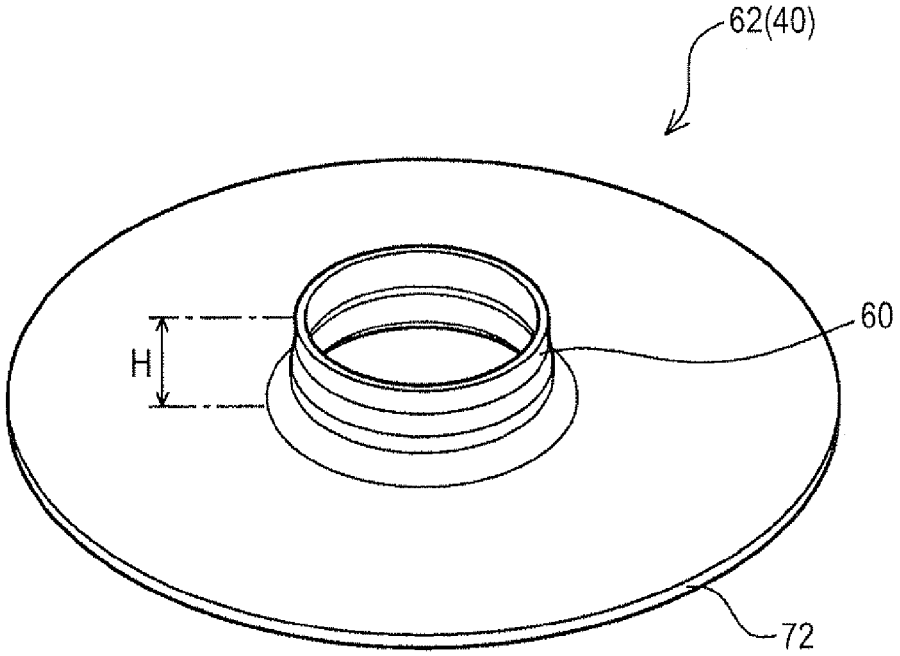
FIG. 13 is an external perspective view of the blank after the burring step.

Next, as the burring step, the burring punch 12 is moved in the upward direction in FIG. 5 (the direction in which the blank 40 is disposed), as shown in FIG. 5. By so doing, it is possible to perform a burring process on the heretofore described preliminary boss 58 and, as shown in FIGS. 9 and 13, to form the disc-like member 62 on which the boss portion 60 with the desired height H is formed. At this time, the burring die 10 holds the blank 40. In this way, while the burring die 10 functions as a punch which presses the blank 40 in the heretofore described drawing step, it functions as a die which holds the blank 40 in the burring step.

A condition is maintained in which the second portion 52 of the blank 40 is clamped by the leading end portion 20 of the burring die 10 and the upper surface 38 of the lifter 18 while pressure is applied to the second portion 52 of the blank 40 from the leading end portion 20 of the burring die 10. By so doing, it is possible to prevent a position misalignment of the blank 40.

Also, in the burring step, a condition is maintained in which the first region 44 of the blank 40 is clamped by the leading end surface 56 of the first holding member 14 and the upper surface 36 of the second holding member 16. By so doing, it is possible to maintain the flatness of the first region 44 of the blank 40.

The movement of each die is not limited to the heretofore described working example. For example, the burring punch 12, the second holding member 16, and the lifter 18 may be moved in the direction in which the burring die 10 and the first holding member 14 are disposed (in the upward direction in FIG. 1) with the burring die 10 and the first holding member 14 fixed. Alternatively, the burring punch 12, the second holding member 16, and the lifter 18 may be moved in the direction in which the burring die 10 and the first holding member 14 are disposed (in the upward direction in FIG. 1) while the burring die 10 and the first holding member 14 are moved in the direction in which the blank 40 is disposed (in the downward direction in FIG. 1).

Figure 14:
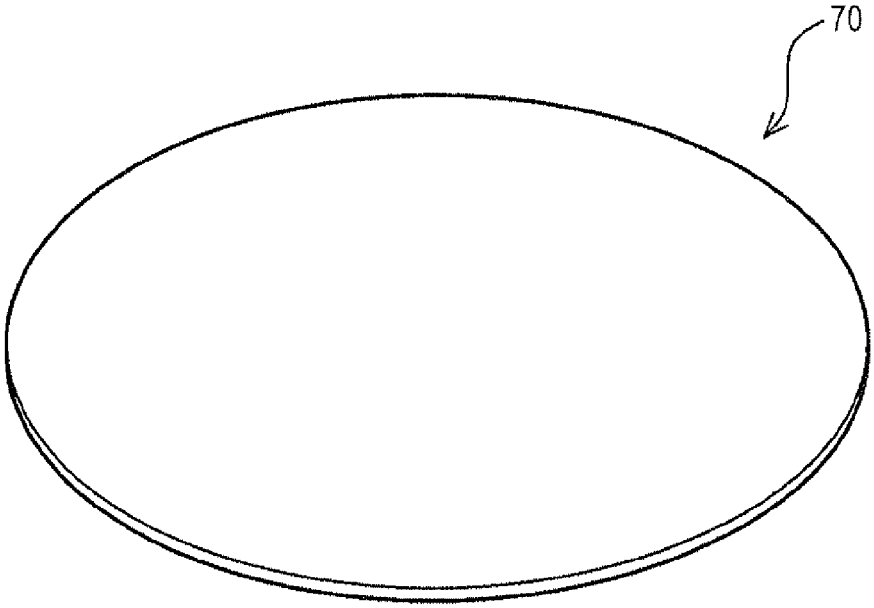
FIG. 14 is an external perspective view of a blank in which no hole is formed in advance.
Figure 15:
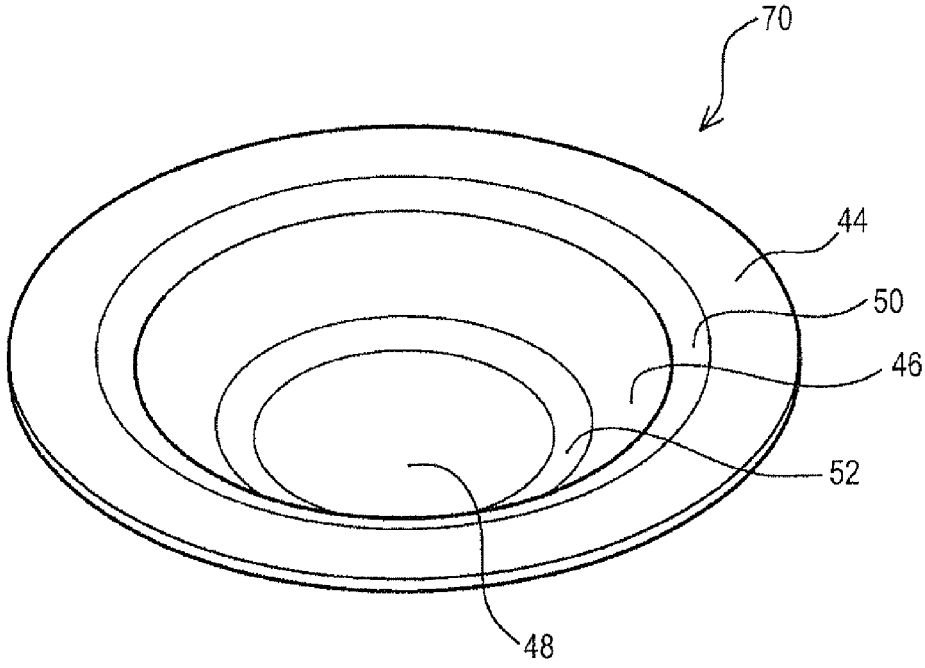
FIG. 15 is an external perspective view of the blank in which no hole is formed in advance after the drawing step.

Also, the manufacturing apparatus 1 and the manufacturing method of the working example can also be applied to a kind of blank 70 shown in FIG. 14 in which the hole 42 is not formed in advance. Specifically, firstly, the kind of blank 70 shown in FIG. 15 is formed by carrying out the initial step and the drawing step in the same way as heretofore described. Next, by carrying out a punching step which forms the hole 42 in the central portion of the blank 70, the blank 70 is formed in a form the same as that of the kind of blank 40 shown in the heretofore described FIG. 11. Next, by carrying out the conical portion formation step in the same way as heretofore described, the blank 70 is formed in a form the same as that of the kind of blank 40 shown in the heretofore described FIG. 12. Next, by carrying out the burring step, it is possible to form the kind of disc-like member 62 shown in the heretofore described FIG. 13 on which the boss portion 60 with the desired height H is formed. In FIGS. 14 and 15, components equivalent to those of the blank 40 in which the hole 42 is formed in advance are shown given the same reference numerals and characters.

[Advantages of Working Example]

According to the working example, the boss portion 60 is formed by processing a blank by deforming it in the thickness direction of the blank 40, 70. For this reason, there is no need for equipment which forcibly presses the outer periphery of the blank 40, 70 as in the heretofore known technology, and it is possible to form the boss portion 60 using the burring die 10, the burring punch 12, and the lifter 18, meaning that it is possible to make the equipment simple. Also, as it is possible to suppress an occurrence of a galling by the dies, it is possible to lengthen the lifespan of the dies. Consequently, it is possible to reduce manufacturing cost. Also, the material configuring the blank 40, 70 gathers toward the central portion, and the capacity of the blank 40, 70 in the central portion increases. Because of this, it is possible to form the boss portion with the desired height H.

Also, it is possible to form the boss portion 60 with the one-stroke movement of the burring die 10 and the lifter 18 in the drawing step and the conical portion formation step. Because of this, it is possible to make the equipment simple, meaning that it is possible to reduce manufacturing cost. Herein, the one-stroke movement of the burring die 10 and the lifter 18 is a movement wherein the burring die 10 and the lifter 18 are reciprocated once in the up-down direction in the drawing step and the conical portion formation step.

Also, as the burring die 10 is used as a punch which presses the blank 40, 70, as well as being used as a die which holds the blank 40, 70, it is possible to reduce the number of dies. For this reason, it is possible to make the equipment simple, meaning that it is possible to reduce manufacturing cost.

Also, in the blank contact step, the drawing step, the conical portion formation step, and the burring step, a condition is maintained in which the second portion 52 of the blank 40, 70 is clamped, while being pressurized, by the burring die 10 and the lifter 18. Because of this, it is possible to prevent a position misalignment of the blank 40, 70 when processing the blank 40, 70. Consequently, the accuracy of the coaxiality of an outer peripheral portion 72 (refer to FIG. 13) of the disc-like member 62 with the boss portion 60 improves. That is, it is possible to suppress position misalignment between a central axis of the outer peripheral portion 72 of the disc-like member 62 and a central axis of the boss portion 60.

Also, in the blank contact step, the drawing step, the conical portion formation step, and the burring step, the first region 44 of the blank 40, 70 remains clamped by the leading end surface 56 of the first holding member 14 and the upper surface 36 of the second holding member 16. Because of this, it is possible to suppress a flow of the material configuring the blank 40, 70 to the outer peripheral side. Consequently, it is possible to form the boss portion 60 with the desired height H. Also, the flatness of the first region 44 of the disc-like member 62 improves.

Also, in the event that the hole 42 is provided in the central portion of the blank 40, 70 in advance, by inserting the first column portion 28 of the burring punch 12 into the hole 42, it is possible to regulate a positional relationship between the blank 40, 70 and burring punch 12 in the radial direction of the blank 40, 70. Because of this, it is possible to carry out a positioning of the blank 40, 70 and each die. Consequently, the accuracy of the coaxiality of the outer peripheral portion 72 (refer to FIG. 13) of the disc-like member 62 with the boss portion 60 further improves. Also, as it is possible to omit the step of making the hole in the central portion of the blank 40, 70, it is possible to make the equipment simple.

The heretofore described embodiment, being simply illustrative, does not limit the invention in any way, and it goes without saying that various improvements and modifications are possible without departing from the scope of the invention.

What is claimed is:

1. A manufacturing method of a bossed disc-shaped member, being formed a boss portion which projects upright in the thickness direction of a disc-shaped member on a surface of the disc-shaped member, comprising:

a level difference formation step which moves a second portion, which is positioned on the inner peripheral side of a first portion in a radial direction of a disc-shaped blank, relative to the first portion in a first direction which is the thickness direction of the blank, thus forming a level difference between the first portion and the second portion;

a conical portion formation step which moves the second portion relative to the first portion in a second direction opposite to the first direction, eliminating the level difference, thus forming a conical portion projecting in the second direction in a region on the inner peripheral side of the second portion; and a burring step which performs a burring process on the conical portion, thus forming the boss portion, a pair of dies disposed across the second portion being moved in the first direction in the level difference formation step, and moved in the second direction in the conical portion formation step.

2. A manufacturing method of a bossed disc-shaped member according to claim 1, wherein the pair of dies are comprised a first die and a second die, and the first die presses the second portion in the level difference formation step, and holds the second portion in the burring step.

3. A manufacturing method of a bossed disc-shaped member according to claim 2, wherein in the level difference formation step, the conical portion formation step, and the burring step, a state is maintained in which the second portion is clamped by the pair of dies, while being pressurized.

4. A manufacturing method of a bossed disc-shaped member according to claim 3, wherein in the level difference formation step, the conical portion formation step, and the burring step, a state is maintained in which a region of the blank on the outer peripheral side of the first portion is clamped by a pair of holding members from the first direction and the second direction.

5. A manufacturing method of a bossed disc-shaped member according to claim 2, wherein in the level difference formation step, the conical portion formation step, and the burring step, a state is maintained in which a region of the blank on the outer peripheral side of the first portion is clamped by a pair of holding members from the first direction and the second direction.

6. A manufacturing method of a bossed disc-shaped member according to claim 1, wherein in the level difference formation step, the conical portion formation step, and the burring step, a state is maintained in which the second portion is clamped by the pair of dies, while being pressurized.

7. A manufacturing method of a bossed disc-shaped member according to claim 6, wherein in the level difference formation step, the conical portion formation step, and the burring step, a state is maintained in which a region of the blank on the outer peripheral side of the first portion is clamped by a pair of holding members from the first direction and the second direction.

8. A manufacturing method of a bossed disc-shaped member according to claim 1, wherein in the level difference formation step, the conical portion formation step, and the burring step, a state is maintained in which a region of the blank on the outer peripheral side of the first portion is clamped by a pair of holding members from the first direction and the second direction.

9. A manufacturing method of a bossed disc-shaped member according to claim 1, wherein in the level difference formation step, the conical portion formation step, and the burring step, a state is maintained in which a region of the blank on the outer peripheral side of the first portion is clamped by a pair of holding members from the first direction and the second direction.

10. A manufacturing method of a bossed disc-shaped member according to claim 1, wherein the blank is provided with a hole in a central portion.

11. A manufacturing method of a bossed disc-shaped member according to claim 1, wherein the pair of dies is moved in the first direction and in the second direction in a condition in which the second portion is clamped by the pair of dies and also in which a region on the inner peripheral side of the second portion remains free so as not to be clamped by the pair of dies.

12. A manufacturing apparatus of a bossed disc-shaped member, being formed a boss portion which projects upright in the thickness direction of a disc-shaped member on a surface of the disc-shaped member, comprising:

a first die and a second die disposed across a second portion which is positioned on the inner peripheral side of a first portion in a radial direction of a disc-shaped blank, wherein the first die and the second die move in a first direction which is the thickness direction of the blank, and press the second portion, thereby moving the second portion in the first direction relative to the first portion, thus forming a level difference between the first portion and the second portion, the first die and the second die move in a second direction opposite to the first direction in a condition in which the second portion is clamped by the first die and the second die and also in which a region on the inner peripheral side of the second portion remains free so as not to be clamped by the first die and the second die, the first die and the second die moving the second portion in the second direction relative to the first portion, eliminating the level difference, thus forming a conical portion projecting in the second direction in a region on the inner peripheral side of the second portion, and a burring process is performed on the conical portion in a condition in which the first die and the second die hold the second portion, thus forming the boss portion.

* * * * *